US007857414B2

(12) United States Patent
Eun et al.

(10) Patent No.: US 7,857,414 B2
(45) Date of Patent: Dec. 28, 2010

(54) PRINTHEAD REGISTRATION CORRECTION SYSTEM AND METHOD FOR USE WITH DIRECT MARKING CONTINUOUS WEB PRINTERS

(75) Inventors: Yongsoon Eun, Webster, NY (US); R. Enrique Viturro, Rochester, NY (US); Howard A. Mizes, Pittsford, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 240 days.

(21) Appl. No.: 12/274,566

(22) Filed: Nov. 20, 2008

(65) Prior Publication Data

US 2010/0123752 A1 May 20, 2010

(51) Int. Cl.
*B41J 29/393* (2006.01)

(52) U.S. Cl. ..... 347/19

(58) Field of Classification Search ..... 347/4, 347/5, 8, 19

See application file for complete search history.

(56) References Cited

U.S. PATENT DOCUMENTS 5,231,428 A 7/1993 Domato et al.
5,397,276 A 3/1995 Chang
5,872,585 A * 2/1999 Donato et al. ..... 347/218
5,874,980 A * 2/1999 West ..... 347/186
5,951,182 A * 9/1999 Van Weverberg et al. ... 400/708
6,972,403 B2 12/2005 Martensen et al.
2005/0263958 A1 12/2005 Knierim et al.
2006/0221124 A1 10/2006 Guarino et al.
2008/0124158 A1 5/2008 Folkins

* cited by examiner

*Primary Examiner*—Lamson D Nguyen
(74) *Attorney, Agent, or Firm*—Maginot, Moore & Beck LLP

(57) ABSTRACT

A registration system for use with an imaging device includes sensors for detecting a web speed and a web tension of a moving web and a control system configured to generate a first timing offset for at least one marking station based on the detected web speed and web tension. An image sensor is configured to generate a signal indicative of a position of a marking material applied to the moving web by at least one of the marking stations. The control system is configured to generate a second timing offset for the at least one marking station based on the position of the marking material indicated by the third signal, and to adjust an actuation time for the at least one marking station using the first timing offset and the second timing offset.

20 Claims, 4 Drawing Sheets

PRINTHEAD REGISTRATION CORRECTION SYSTEM AND METHOD FOR USE WITH DIRECT MARKING CONTINUOUS WEB PRINTERS

TECHNICAL FIELD

The present disclosure relates to forming images on a substantially continuous moving web, and, in particular, to the registration of images formed on the moving web.

BACKGROUND

To provide accurate printing of images, multicolor digital marking systems need to maintain adequate color to color registration. In systems that utilize an elongate image receiving surface, such as a paper web or a belt, the receiving surface reaches a first marking station where a marking material of a first color is applied to the surface, e.g., by firing ink jets, exposing an image on a photoconductive material, or applying toner particles to a selectively imaged photoconductive member. The receiving surface then moves on to a second marking station, where an image or marking material of a second color is applied, and so forth, depending on the number of colors.

Precise control of the timing of actuation of the marking stations is necessary so that the separate single color images deposited onto the web by the different print heads are precisely overlaid, or registered, on the web in order to produce the desired output color image. A continuous web, such as a length of paper or photoreceptor belt, however, may be a stretchable medium. Therefore, variations in the speed of the web at different locations in the web can cause the web to stretch or change length. Web stretch can affect the time at which a specific portion of the web reaches a marking station which in turn may cause a particular marking station to apply marking material at the wrong location on the web resulting in image registration errors.

Misregistration of images on the web may also result from other factors such as thermal expansion, mechanical vibrations, and other sources of disturbances on the machine components that may alter marking station positions or angles of incidence relative to the web. Slight deviations in position or angle of incidence from manufactured settings may cause marking material to be applied to the web by a marking station too early or too late relative to marking material applied by other marking stations resulting in process direction registration errors.

SUMMARY

In order to register the formation of images on a moving web, a registration system has been developed that enables the adjustment of actuation times for the marking stations to compensate for variations in web speed and tension as well as marking station displacement due to mechanical disturbances on the machine components. In particular, in one embodiment, a registration system for use with an imaging device comprises a first sensor configured to generate a first signal indicative of a speed of a substantially continuous moving web, and a second sensor configured to generate a second signal indicative of a tension of the moving web. The system includes an image sensor configured to generate a third signal indicative of a position of a marking material applied to the moving web by at least one of the marking stations. A control system is coupled to the first sensor, the second sensor and the image sensor. The control system is configured to generate a first timing offset for the at least one of the marking stations with reference to the first signal and the second signal, and to generate a second timing offset for the at least one of the marking stations with reference to the first signal, the second signal and the third signal. The first timing offset and the second timing offset each are configured to advance or delay actuation of the at least one marking station to apply marking material to the moving web. The control system is configured to adjust an actuation time for the at least one marking station using the first timing offset and the second timing offset.

In another embodiment, a method of registering images on a substantially continuous moving web comprises detecting a speed of a moving web; detecting a tension of the moving web; generating a first timing offset based on the detected speed and the detected tension of the moving web; adjusting an actuation time for at least one marking station positioned adjacent the moving web using the first timing offset to form a first adjusted actuation time for the at least one marking station; actuating the at least one marking station to apply a registration mark to the moving web using the first adjusted actuation time; detecting a process direction deviation of the applied registration mark from an intended location of the registration mark on the moving web; generating a second timing offset based on the detected process direction deviation; and adjusting the first adjusted actuation time for the at least one marking station using the second timing offset to form a second adjusted actuation time for the at least one marking station.

In yet another embodiment, an imaging device comprises a substantially continuous image receiving web, and a web transport and guidance system for moving the web through a print zone. A first and a second marking station are sequentially positioned in the print zone and configured to apply marking material to the moving web. A first sensor is configured to generate a first signal indicative of a speed of the moving web; and a second sensor is configured to generate a second signal indicative of a tension of the moving web. The system includes an image sensor configured to generate a third signal indicative of a position of a marking material applied to the moving web by at least two of the marking stations. A control system is coupled to the first sensor, the second sensor and the image sensor. The control system is configured to generate a first timing offset for the at least one of the marking stations with reference to the first signal and the second signal, and to generate a second timing offset for the at least one of the marking stations with reference to the third signal. The first timing offset and the second timing offset each are configured to advance or delay actuation of the at least one marking station to apply marking material to the moving web. The control system is configured to adjust an actuation time for the at least one marking station using the first timing offset and the second timing offset.

DETAILED DESCRIPTION

Figure 1:
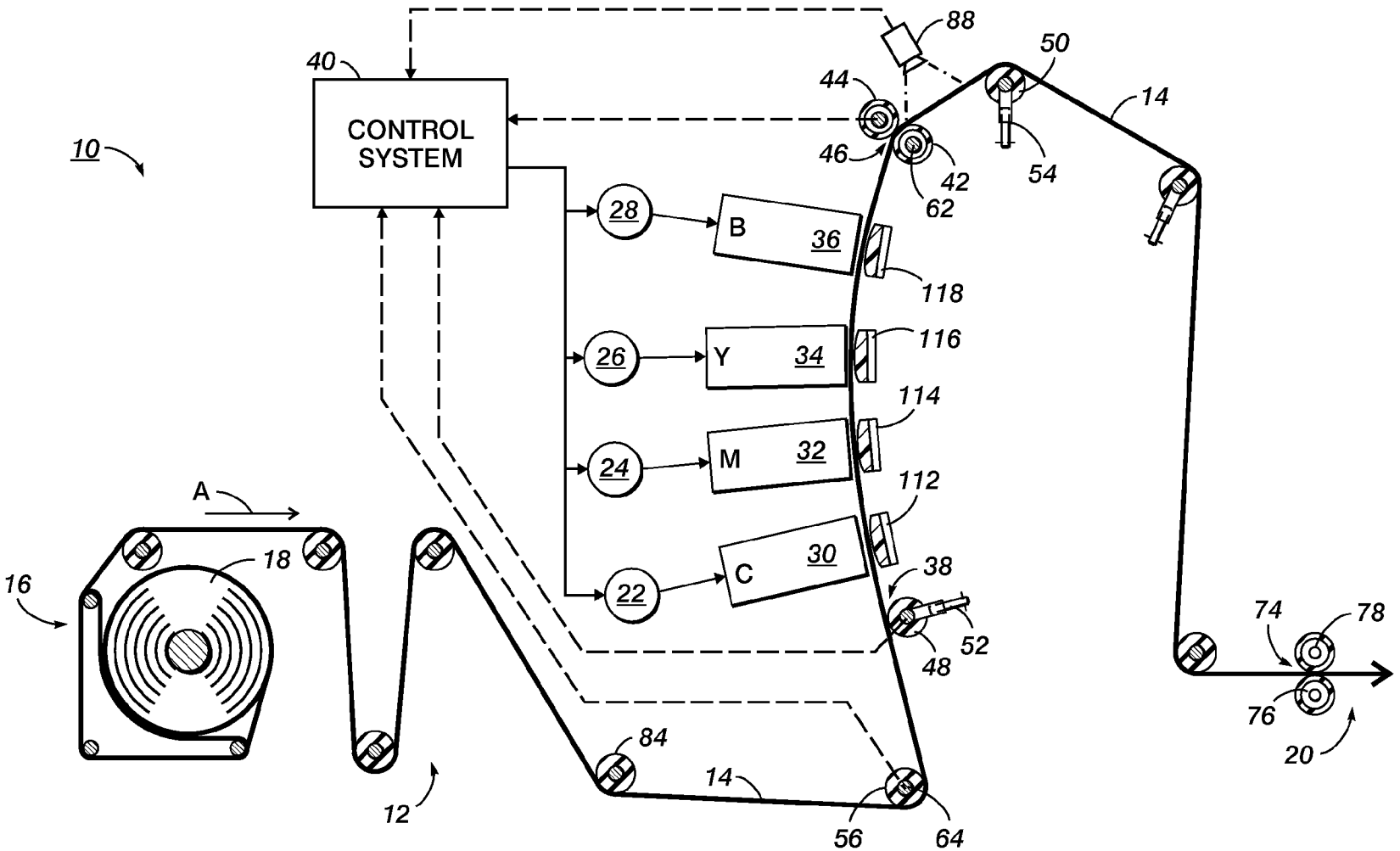
FIG. 1 is a schematic elevational view of a direct-to-sheet, continuous-web, imaging device.

For a general understanding of the present embodiments, reference is made to the drawings. In the drawings, like reference numerals have been used throughout to designate like elements.

Aspects of the exemplary embodiment relate to an imaging device and to a registration system for an imaging device. The imaging device includes an extensible image receiving member, such as a web or belt, which defines an image receiving surface that is driven in a process direction between marking stations. As used herein, the process direction is the direction in which the substrate onto which the image is transferred and developed moves through the image transfer and developing apparatus. The cross-process direction, along the same plane as the substrate, is substantially perpendicular to the process direction.

The imaging device can include any device for rendering an image on print media, such as a copier, laser printer, bookmaking machine, facsimile machine, or a multifunction machine, all of which may generally be referred to as printers. The operation of applying images to print media, for example, graphics, text, photographs, etc., is generally referred to herein as printing or marking.

The image receiving member can be a web of print media, such as a continuous web of print media having a length substantially greater than its width and substantially greater than the distance between first and second marking stations. The print media can be paper, plastic, or other suitable physical print media substrate for images. Alternatively, the image receiving member can be a flexible belt, such as a photoreceptor belt, which may be in the form of a loop. Images applied to the belt at the first and second marking stations are transferred to a sheet of print media at a transfer station. In general, the web of print media or belt is one which has sufficient extensibility in the process direction that differences in tension in the web can result in misregistration of images applied by the first and second print stations. While the image receiving member will frequently be described herein in terms of a web of paper, it is to be appreciated that other image receiving members are also contemplated.

As used herein, an image can comprise a pattern of applied marking medium such as ink or toner. Or, the image may comprise a latent image, such as may be formed by exposing (e.g., discharging) portions of a photoreceptor belt surface, to which a marking medium such as a toner is subsequently applied.

With reference to FIG. 1, a first embodiment of a multicolor digital marking system 10 is illustrated in the form of an ink jet printing system. The system 10 includes a conveyor system 12, which conveys a web 14 of paper along a paper path in a process direction indicated generally by arrow A through a print zone located between an upstream end 16, herein illustrated as comprising an unwinder 18, and a downstream end 20, such as a take up roller (not shown). The printing system 10 includes a plurality of marking stations 22, 24, 26, 28, one for each of the ink colors to be applied, cyan, magenta, yellow, and black, in the illustrated embodiment. The marking stations 22, 24, 26, 28 are arranged at spaced locations along the paper path in the print zone. Each of the marking stations 22, 24, 26, 28 includes a print head assembly 30, 32, 34, 36, respectively, which applies a marking media to desired locations on the web. In the embodiment of FIG. 1, each print head assembly 30, 32, 34, 36 includes a plurality of print heads that are arranged side by side so as to span the width of the web in the cross-process direction. For example, in one embodiment, each print head assembly 30, 32, 34, 36 may include four print heads. In alternative embodiments, each marking station may include a single full width array printhead that spans the width of the web in the cross-process direction.

In one embodiment, the marking media applied to the web is a "phase-change ink," by which is meant that the ink is substantially solid at room temperature and substantially liquid when initially jetted onto the web 14. Currently-common phase-change inks are typically heated to about 100° C. to 140° C., and thus in liquid phase, upon being jetted onto the web W. Generally speaking, the liquid ink cools down quickly upon hitting the web W. In alternative embodiments, however, any suitable marking material or ink may be used including, for example, toner or aqueous ink. Associated with each primary color printhead is a backing member 112, 114, 116, 118, typically in the form of a bar or roll, which is arranged substantially opposite the printhead on the other side of web. Each backing member is used to position the web so that the gap between the printhead and the web stays at a known, constant distance.

The illustrated conveyor system 12 includes a plurality of guide members such as rollers, which guide the paper web 14 through the print zone past the marking stations, generally through contact with the web. At least one of the rollers 42 is a drive roller which is driven in the process direction by a motor or other suitable drive system (not shown). The drive roller 42 engages a second roller 44 to form a drive nip 46 therebetween. The driven roller 42 applies a driving force to the paper web as it passes through the nip 46. The drive motor is configured for driving the drive roller 42, and hence paper web 14, at a substantially constant preset speed. However, the speed of the driven roller 42 may fluctuate over time, i.e., vary from its preset speed, such that the speed of the web passing through the nip 46 also fluctuates slightly over time. The second roller 44 may be a driven roller or a non-driven (idler) roller. In the illustrated embodiment, the print heads 22, 24, 26, 28 are spaced along the paper path at various distances upstream from the nip 46.

One or more rollers downstream and/or upstream of the driven roller 42 may be tension rollers. Tension rollers attempt to maintain a constant tension on the web 14, at least in the print zone, without applying a driving force. In one embodiment, rollers 48, 50 may be configured to create a small amount of tension in the web to keep the web taut as it moves through the printing system 10. Accordingly, rollers 48 and 50 may be biased towards the web 14 by tension members, such as springs 52, 54. Although rollers 48, 50 in the schematic diagram of FIG. 1 are shown as having a minimal web wrap or wrap length with respect to web 14, tension rollers in actual implementations may have significantly more web wrap. The wrap length at which the web is in contact with tension rollers, such as rollers 48 and 50, may be any suitable wrap length that enables the tension rollers to impart a desired amount of tension to the web. Additionally or alternatively, the proper level of tension in the web may be created with or without tension members 52 or 54 by controlling the web speed. Generally however there might be load cells or tensionometers at one or more locations to aid in the web speed control. Other rollers such as roller 56, upstream of the heads, may serve a guiding function, with or without applying any tension.

The print head assemblies 30, 32, 34, 36 are under the control of a control system 40, which controls the firing of the print heads of the print head assemblies such that an image generated by the second marking station 24 (and subsequent marking stations 26, 28) is superimposed over an image applied by the first marking station 22. The control system 40 may comprise a central processing unit (CPU) which executes instructions stored in associated memory for generating firing times/ adjustments for the print heads, or the control system may be another suitable computer controlled device. In one embodiment, the control system 40 may form a part of an overall control system for the imaging device 10, which also provides image data to the marking stations.

Precise control of the timing of actuation of the print heads is necessary so that the separate single color images deposited onto the web by the different print heads are registered. As used herein, the term "registered" means superimposed, or overlaid, in the case of print heads of different marking stations that are aligned in the process direction, or registered side by side in the case of the print heads of different marking stations or the same marking station that are not aligned, i.e., offset from each other in the cross-process direction. During operation, the control system actuates one or more of the print heads of the first print head assembly 30 to apply marking material of at a desired location on the web as the web is being transported through the print zone. The timing of the actuation of the print heads of the second print head assembly 32 and subsequent print head assemblies 34, 36 is controlled as a function of the speed of the web so that the images applied by the print heads of the second and subsequent print head assemblies are registered on top of or beside the image(s) applied by the print head(s) of the first print head assembly to form a composite, multicolor image on the web. As explained below, web speed may be detected using a web speed sensor such as an encoder. The position of each print head assembly relative to the other print head assemblies is known or predetermined. Accordingly, the time for actuating the print heads of the first, second, and subsequent print head assemblies may be calculated based on their respective distances from the print heads of the other print head assemblies and the determined speed of the web.

In the embodiment of FIG. 1, the marking system includes an encoder associated with the drive roller 42 (or alternatively with driven roller 44). The encoder 62 may be a rotary encoder which is mounted to an axial shaft of the roller 42 (or 44) in a location outwardly spaced from the nip region 46. The encoder 62 may output a fixed number of electrical pulses (clicks) for each rotation of the drive roller 42. Based on a frequency of the clicks, a speed of the paper as it passes through the nip 46 can be determined. For example, web speed may be computed by multiplying the circumference of the driven roller 42 (which may be increased to account for the thickness of the web) by a constant value (a function of the number of clicks per revolution) times the frequency of the clicks (e.g., clicks/second). The encoder information, either as the unprocessed raw data or a calculated web speed, is communicated to the control system 40.

The control system may use the web speed as indicated by the encoder to control the actuation times for each of the print heads. For example, the control system may be configured to actuate the print heads of the second print head assembly 32 a first predetermined number of encoder pulses or clicks after actuation of the print heads of the first print head; to actuate the print heads of the third print head assembly a second predetermined number of encoder pulses or clicks after actuation of the print heads of the second print head assembly (or first print head assembly); etc. Absent stretching of the web, the timing of the actuation of the print heads based on the measurement of the speed of the web, e.g., encoder pulses, and the known print head positions enables a substantially accurate registration of the images on the web applied by the different print heads.

A web, such as a length of paper or photoreceptor belt, however, may be a stretchable medium. Therefore, variations in tension applied to the web as well as variations in web speed that may be introduced by the drive roller(s) can cause the web to stretch or change length. Web stretch can affect the time at which a specific portion of the web reaches a print head or travels between print heads which in turn may cause a particular print head to print some or all of an image at the wrong location on the web resulting in image misregistration on the web.

Figure 2:
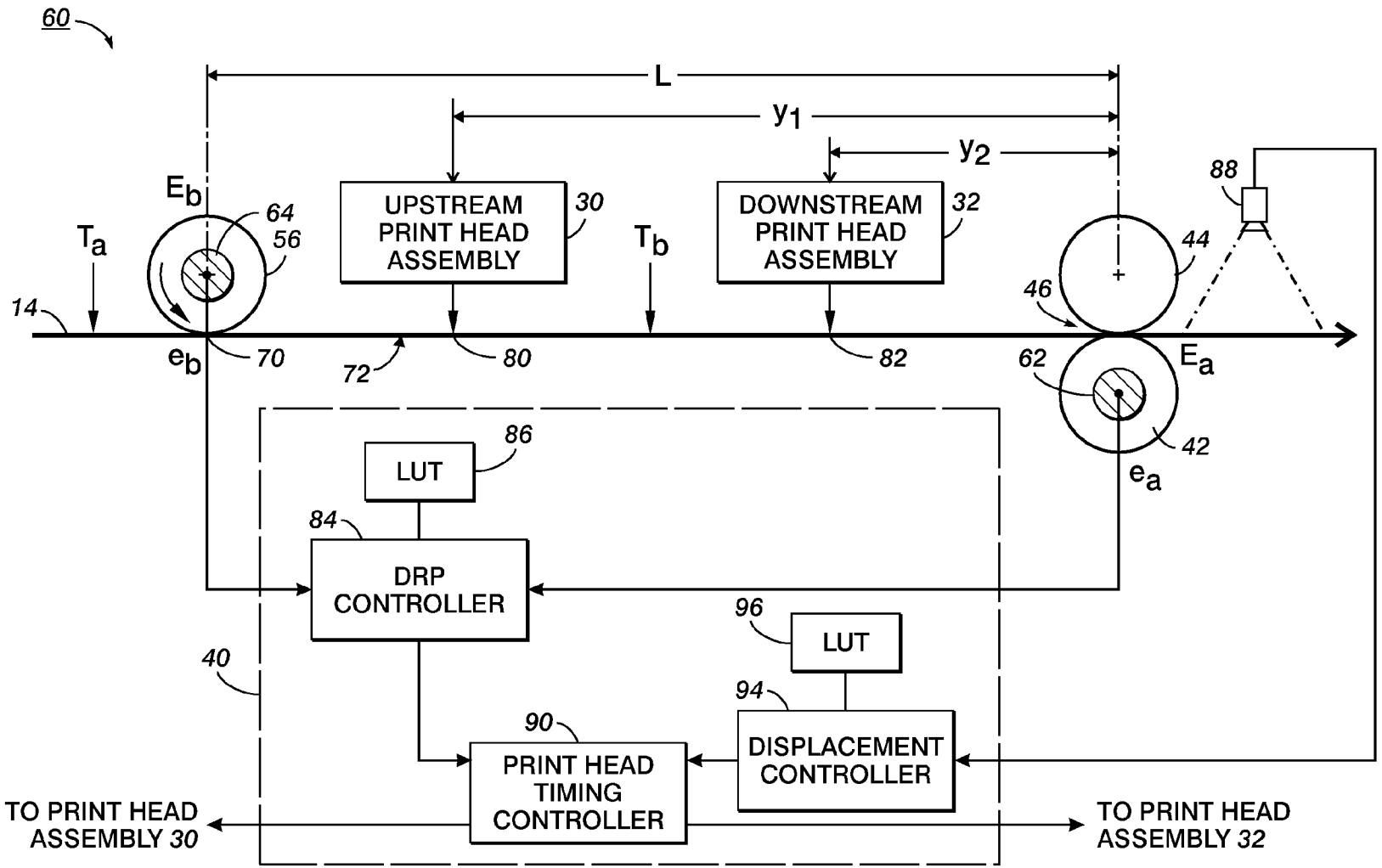
FIG. 2 is a schematic diagram of a registration system for use with the imaging device of FIG. 1.

In order to compensate for registration errors that may be introduced due to time varying changes in tension of the web, the imaging device may include a registration system 60. The registration system 60 in FIG. 2 incorporates a double reflex printing (DRP) registration system. FIG. 2 shows only two print head assemblies 30, 32, for ease of representation, although it is to be appreciated that three, four, or more print head assemblies may be provided, as shown in FIG. 1. The DRP registration system includes a first measurement device in the form of an encoder 62, which is associated with the drive roller 42 (or alternatively with driven roller 44) and a second measurement device in the form of an encoder 64 associated with roller 56. Both of the encoders 62, 64 may be rotary encoders which are mounted to an axial shaft of the respective roller in a location outwardly spaced from the nip region 46 (or web contacting region in the case of roller 56). Although roller 56 is a single roller, it is also contemplated that roller 56 may be one of a pair of rollers, similar to rollers 42, 44 which define a nip. The first encoder 62 may output a fixed number of electrical pulses (clicks) for each rotation of the drive roller 42. As mentioned above, based on a frequency of the clicks, a speed of the paper as it passes through the nip 46 can be determined.

The second measuring device 64 is used by the control system 40 to account for the variation in stretch of the web over time. In this way, the firing of the print heads of the print head assemblies 30, 32, 34, 36 can be adjusted by the control system 40 to account for both a change in the measured speed of the web 14 and a change in stretch in the web. In the registration system 60, illustrated in FIG. 2, the second measuring device, illustrated as encoder 64, measures the speed of roller 56 and hence the speed of web at a contact zone 70. In the exemplary embodiment, roller 56 is a guide roller, although it may alternatively be a driven roller or a tension roller. The speed of the web at roller 56 may vary, slightly, from the set speed, as for roller 42, resulting in changes in tension, over time in a printing zone 72 of the paper web which extends between the two contact zones 46, 70. Encoder 64 may be similarly configured to encoder 62. In particular, encoder 64 outputs a fixed number of pulses (clicks) for each rotation of the guide roller 56. Based on a frequency of the clicks, a speed of the paper web 14 as it passes through the zone 70 can be determined as discussed above. The encoder information, either the unprocessed raw data or a calculated web speed, is communicated to a DRP controller 84.

The encoder 62 provides a first source of web-speed related information, namely the rotation speed of the drive roll 42, from which the speed of the paper passing through nip 46 can be derived. The encoder 64 provides a second source of web-speed related information, namely the rotation speed of the guide roll 56, from which the speed of the paper passing through zone 70 can be determined. In the illustrated embodiment, the first encoder 62 provides information for determining the web speed at a position 46 downstream of the second print head 32 and the second encoder 64 provides information for determining the web speed at a position 70 upstream of that of the first encoder 62 and upstream from the first print head assembly 30. In the exemplary embodiment, the print head assemblies 30, 32 of the first and second marking stations 24, 26 are located intermediate the first and second monitoring positions 46, 70.

Based on a determination of the web speed at positions 46 and 70, a tension $T_b$ in the printing zone 72 of the web 14 between the two positions 46, 70 can be calculated. In the embodiment illustrated in FIG. 2, there are no significant additional sources of tension between the two monitoring positions 46, 70 so the tension can be presumed to be the same throughout printing zone 72.

In one embodiment, the position and tension $T_b$ in the web is determined from the difference in speed determined at the first and second positions 46, 70 and the Young's modulus of the web. This determination may also rely on an input tension $T_a$ being known. Since the modulus of the web, clicks/revolution of each encoder, and dimensions of the rollers are all constants, the tension $T_b$ can be determined as a function of the two click frequencies. In alternative embodiments, the tension $T_b$ can be determined using a web tension sensor, such as a tensiometer, or a combination of sensors, such as encoder and a web tension sensor, that are configured to detect the tension of the web in the print zone.

Based on the determined tension $T_b$ in the web, a firing time adjustment, referred to herein as a DRP offset, can be determined for the downstream marking station 24 to account for any change in tension of the web from the tension when the firing time was set. The firing time adjustment, or DRP offset, is also based on a change in web speed, which for a print head intermediate the two positions 46, 70, can be determined as a function of its distance from the measurement positions. The DRP offset is thus based on the position of the first and second print head assemblies 30, 32, relative to the first and second positions 46, 70.

For example, the distances $y_1$, $y_2$ and L, which are fixed, may be known, where $y_1$ represents the distance from the first position 46 to a position 80 on the web at which a line of an image from at least one print head of the print head assembly 30 is to be applied, $y_2$ represents the distance from the first position 46 to a position 82 on the web at which a line of an image from at least one print head of the print head assembly 32 is to be applied in superimposition on or beside the first line, and L represents the distance between the first and second positions. As will be appreciated, the change in tension in the web affects the time at which a specific portion of the web reaches both print head assembly 30 and print head assembly 32, however, in the present case, the firing times of only one of the two print head assemblies (print head assembly 32, for example) is adjusted, based on their relative positions along distance L.

In practice, DRP timing offsets may be determined from the detected web speed and web tension provided by the encoders 62, 64 in any suitable manner. In one embodiment, the DRP control system 84 may be configured to use the sensor values from the encoders as reference or lookup values for accessing a data structure such as a lookup table 86 stored in memory accessible by the control system that has been populated with DRP offset values referenced to web speed and/or tension values. Alternatively, the DRP control system 84 may include a program or subroutine for calculating the DRP offset based on the detected web speed and tension values. For a more detailed description of a DRP registration system and different methods of determining DRP offsets based on time varying changes in tension of the web, please refer to U.S. Publication No. 20080124158 published May 29, 2008 to Folkins which is hereby incorporated by reference herein in its entirety.

Once a DRP offset value has been determined for one or more of the print heads, the DRP offset may be saved in memory, for example, for the print head timing control system 90 to access so that the DRP offsets may be used to subsequently adjust actuation times for the print heads. In addition, DRP offset determination for the print heads may be performed at any suitable interval such as continuously, periodically, or on an as needed basis, and the DRP offsets may be updated so that continued changes or variations in web speed and tension may continuously compensated for over time. In any event, once determined, DRP offset values may be communicated to the print head control system 90 so that the DRP offsets may be used to adjust the actuation time of the print heads to enable accurate registration of images on the web.

The print head timing control system 90 may be configured to time the actuation of each print head based on a fixed delay that corresponds to a predetermined unit of measure such as encoder pulses or clicks. Thus, for example, referring to FIG. 2, print heads of print head assembly 32 may be set to fire x clicks of encoder 62 (or encoder 64) after print heads of print head assembly 30. In one embodiment, the firing time for print heads of print head assembly 32, for example, may be adjusted to x+y counts to provide good alignment of image lines, where y represents the DRP offset for the print heads of print head assembly 32. The DRP offset (y) may be a positive value in the case of an increase in web tension and may be a negative value in the case of a decrease in tension. Note that an increase in tension signifies that the tension in the web 72 between positions 46 and 70 is higher than at the time the original value of x was determined. Thus, the DRP registration system is configured to determine a DRP offset for each print head positioned along the web path which may be used by the control system 90 to adjust the predetermined actuation time for each print head so that each image applied by the various print heads is correctly registered on the web to form the desired composite color image.

Figure 3:
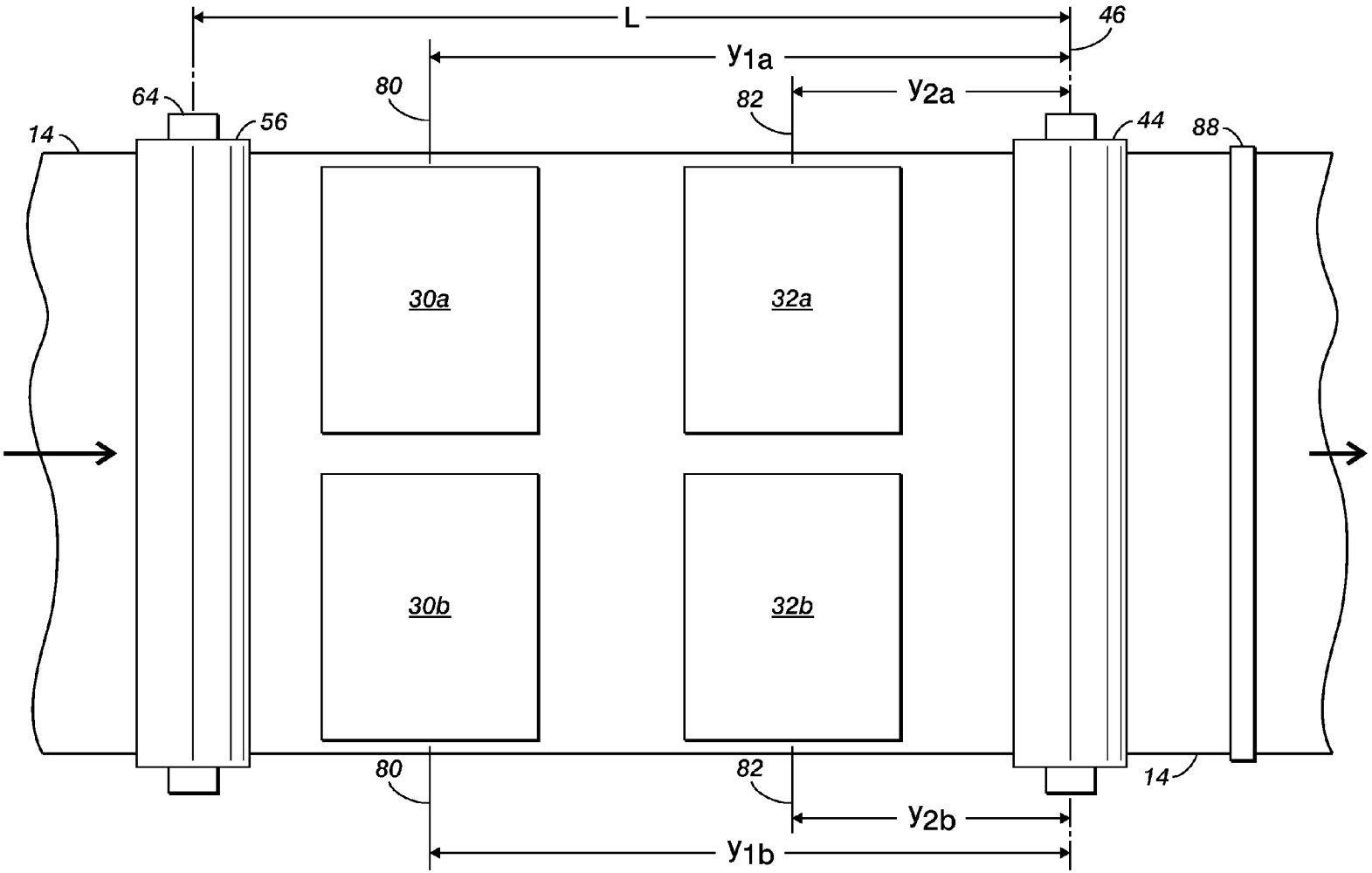
FIG. 3 is a schematic diagram of a top view of the registration system of FIG. 2.

Misregistration of images on the web, however, may also result from other factors such as thermal expansion, mechanical vibrations, and other sources of disturbances on the machine components that may alter print head positions or angles of incidence relative to the web. Slight deviations in print head position or angle of incidence from manufactured settings may cause the marking material to be applied to the web by a print head too early or too late relative to marking material applied by the print heads of the other print head assemblies or the marking material applied by the other print heads of the same print head assembly resulting in process direction registration errors. For example, FIG. 3 is a top view of the registration system of FIG. 2 showing print head assembly 30 having print heads 30*a* and 30*b*, and print head assembly 32 having print heads 32*a* and 32*b*. The distances $y_{1a}$, $y_{1b}$, $y_{2a}$, $y_{2b}$, and L, which are fixed, may be known, where $y_{1a}$ represents the distance from the first position 46 to a position 80 on the web 14 which a line of an image from print head 30*a* is to be applied, where $y_{1b}$ represents the distance from the first position 46 to a position 82 on the web 14 which a line of an image from print head 32*a* is to be applied, where $y_{2a}$ represents the distance from the first position 46 to the position 80 on the web 14 which a line of an image from print head 30*b* is to be applied, and where $y_{2b}$ represents the distance from the first position 46 to the position 82 on the web 14 which a line of an image from print head 32*b* is to be applied. Initially, the distances $y_{1a}$ and $y_{1b}$ are substantially the same and are set during manufacturing and setup of the imaging device. Similarly, the distances $y_{2a}$ and $y_{2b}$ are substantially the same. Thermal expansion, mechanical vibrations, and other sources of disturbances on the machine components, however, may alter print head positions or angles of incidence of one or more of the print heads 30*a*, 30*b*, 32*a*, 32*b* relative to the web which in turn may cause process direction changes in the corresponding distance $y_{1a}$, $y_{1b}$, $y_{2a}$, or $y_{2b}$. A process direction change in one or more of the distances, such $y_{2a}$, for example, may cause the print head 32*a* to apply marking material to the web too early or too late relative to print heads 30*a* and 30*b*, as well as print head 32*b* resulting in registration errors.

Process direction registration errors that occur due to print head position deviations may result even when time varying changes in tension of the web are accounted for using the DRP registration system. Accordingly, the present disclosure proposes integrating a DRP registration system with a print head displacement registration system that is configured to determine print head displacement errors using an image sensor positioned along the web path to detect process direction registration errors that may be introduced due to mechanical disturbances and machine wear, and to generate a print head displacement offsets for the print heads. Print head displacement offsets are timing values that are used by the control system to advance or delay the actuation of a print head to apply marking material to the web to compensate for the detected print head displacement errors.

Referring again to FIGS. 2 and 3, the print head displacement compensation system includes an image sensor 88 positioned along the web path downstream from the print zone for detecting or sensing image misregistration on the web, and a print head displacement correction control system 94 that is configured to generate a print head displacement timing offset for one or more of the print heads based on image misregistration indicated by the image sensor. In one embodiment the image sensor 88 comprises a full width array (FWA) sensor having an array length that spans substantially the entire effective width of the web in the cross-process direction. The FWA sensor 94 is configured to detect, for example, the presence, intensity, and/or location of marking material applied to the web by the print heads. Accordingly, in one embodiment, the FWA sensor 88 includes a light source and a light sensor (not shown in FIGS. 2 and 3). The light source may be a single light emitting diode (LED) that is coupled to a light pipe that conveys light generated by the LED to one or more openings in the light pipe that direct light towards the web. In one embodiment, three LEDs, one that generates green light, one that generates red light, and one that generates blue light are selectively activated so only one light shines at a time to direct light through the light pipe and be directed towards the web. In another embodiment, the light source is a plurality of LEDs arranged in a linear array. The LEDs in this embodiment direct light towards the web. The light source in this embodiment may include three linear arrays, one for each of the colors red, green, and blue. Alternatively, all of the LEDS may be arranged in a single linear array in a repeating sequence of the three colors. Alternatively, the LED's may be of a single color or white. The reflected light is measured by the light sensor. The light sensor, in one embodiment, is a linear array of photosensitive devices, such as photodiodes or charge coupled devices (CCDs). The photosensitive devices generate an electrical signal corresponding to the intensity or amount of light received by the photosensitive devices. The array of photosensitive devices extends substantially across the width of the web.

The FWA sensor 88 is configured to output reflectance signals to the print head displacement correction control system 94 that are indicative of the reflectance of light from the web detected by the light sensors of the FWA sensor. As explained below, the reflectance signals may be used by the displacement control system 94 to derive information pertaining to the marking material applied to the web such as the presence and/or location of the marking material on the web as well as deviations of the detected location of the marking material on the web from intended locations for the marking material on the web.

The print head displacement control system 94 is configured to provide control signals to the FWA sensor 88 that, for example, selectively activate the LEDS to direct light onto the web and/or activate the light sensors to detect reflected light from the web. In one embodiment, the activation of the light sources and light sensors of the FWA sensor may be synchronized to one of the encoders 62, 64 so that web is scanned only in targeted areas of the web such as where images from one or more of the print heads are formed.

Image registration errors may be detected using the FWA sensor 88 in any suitable manner. In one embodiment, as explained below, the print head control system 90 is configured to actuate the print heads to apply registration marks onto the moving web. Registration marks may be any suitable type of mark such as an array of dashes, lines, "Z" shaped marks, chevrons, etc. that enable a determination or detection of deviations of the measured position of the mark on the web from intended positions of the mark on the web. Registration marks may be printed on the web at any suitable location during normal printing operations such as in inter-document or inter-image zones on the web or on the shoulders or margins of the web as is known in the art. Registration marks, however, may be printed at any desired location on the web when the imaging device is not otherwise being used to form images on the web.

Registration marks may be printed in accordance with DRP adjusted print head actuation times that are derived from web speed and web tension measurements determined using the DRP registration system. The use of DRP offsets to adjust the actuation times of the print heads when applying registration marks to the web enable a substantially accurate determination of the intended location on the web that registration marks are to be applied. Therefore, in one embodiment, print head displacement errors may be detected by actuating at least one print head, such as print head 30*a*, for example, (FIG. 3) to apply a reference registration mark, and actuating one or more other print heads to apply a registration mark superimposed over the reference registration mark, in the case of print heads aligned in the process direction, such as print head 32*a*, or beside the reference registration mark in the case of print heads of the same (print head 30*b*) or different print head assemblies (print head 32*b*) that are offset from each other in the cross-process direction. Displacement errors may then be detected using the FWA sensor 88 by comparing the detected position of the reference registration mark to the registration marks applied by the other print heads. As can be ascertained by one skilled in the art with reference to the present disclosure, a number of alternate methods of detecting print head displacement errors using registration marks and image sensors on the web may be utilized.

The FWA sensor 88 is configured to output reflectance signals to the print head displacement control system 94 that are indicative of the print head displacement errors for one or more of the print heads. Based on a detected print head displacement error for a print head indicated by the FWA sensor, the print head displacement control system 94 may generate a print head displacement offset that is configured to delay or advance the actuation of the print head in order to compensate for any change in print head position or angle that may be introduced due to mechanical disturbances, thermal expansion, or component wear over time which may cause a corresponding misregistration of images on the web. Different print heads at different cross process positions at the same process direction position may be delayed or advanced by different amounts based on the measured registration error.

Print head displacement offsets may be generated from the detected print head displacement errors provided by the FWA sensor 88 in any suitable manner. In one embodiment, the print head displacement control system 94 may be configured to use the sensor values from the FWA sensor as references or lookup values for accessing a data structure such as a lookup table 96 stored in memory accessible by the print head displacement control system that has been populated with print head displacement offset values. Alternatively, the print head displacement control system 94 may include a program or subroutine for converting distance values corresponding to print head displacement errors indicated by the FWA sensor to appropriate print head displacement timing offset values. In some embodiments, the controller 94 may be configured to compare the determined print head displacement error indicated by the reflectance signals from the image sensor to a threshold value or threshold range of values prior to generating the corresponding print head displacement offset. For example, the controller 94 may be configured to generate an offset value for a print head if the displacement error is greater than a predetermined error value or within a predetermined error range. Significantly large detected displacement errors may be indicative of a print head fault that may not be correctable and that may require a service call. Accordingly, the controller may be configured to compare the displacement error to a predetermined fault level displacement error value and to generate a user alert or service fault if the detected displacement error is greater than the predetermined fault level displacement error value.

Once a print head displacement offset value has been determined for one or more of the print heads, the print head displacement offset may be saved in memory, for example, for the print head control system 90 to access so that the print head displacement offsets may be used in conjunction with DRP offsets to adjust actuation times for the print heads to compensate for registration errors that may be introduced due to time varying changes in tension of the web as well as registration errors that may be introduced due to print head displacement that may occur over time. For example, with reference to FIG. 3, print head 32*a* may be set to fire x clicks of encoder 62 (or encoder 64) after print head 30*a* (or 30*b*). As mentioned, the firing time for print head 32*a*, for example, may be adjusted to x+y counts to provide good alignment of image lines, where y represents the DRP offset for print head 32*a*. The DRP offset (y) may be a positive value in the case of an increase in web tension and may be a negative value in the case of a decrease in tension. To compensate for print head displacement errors detected by the print head displacement system, the firing time may be further adjusted to x+y+z counts after the firing or actuation of print head 30*a* where z represents the print head displacement offset value for print head 32*a*. Similar to the DRP offset, the print head displacement offset (z) may be a positive value or a negative value depending on whether the displacement error for the print head causes the print head to apply marking material to the web too early or too late relative to print head 30.

Figure 4:
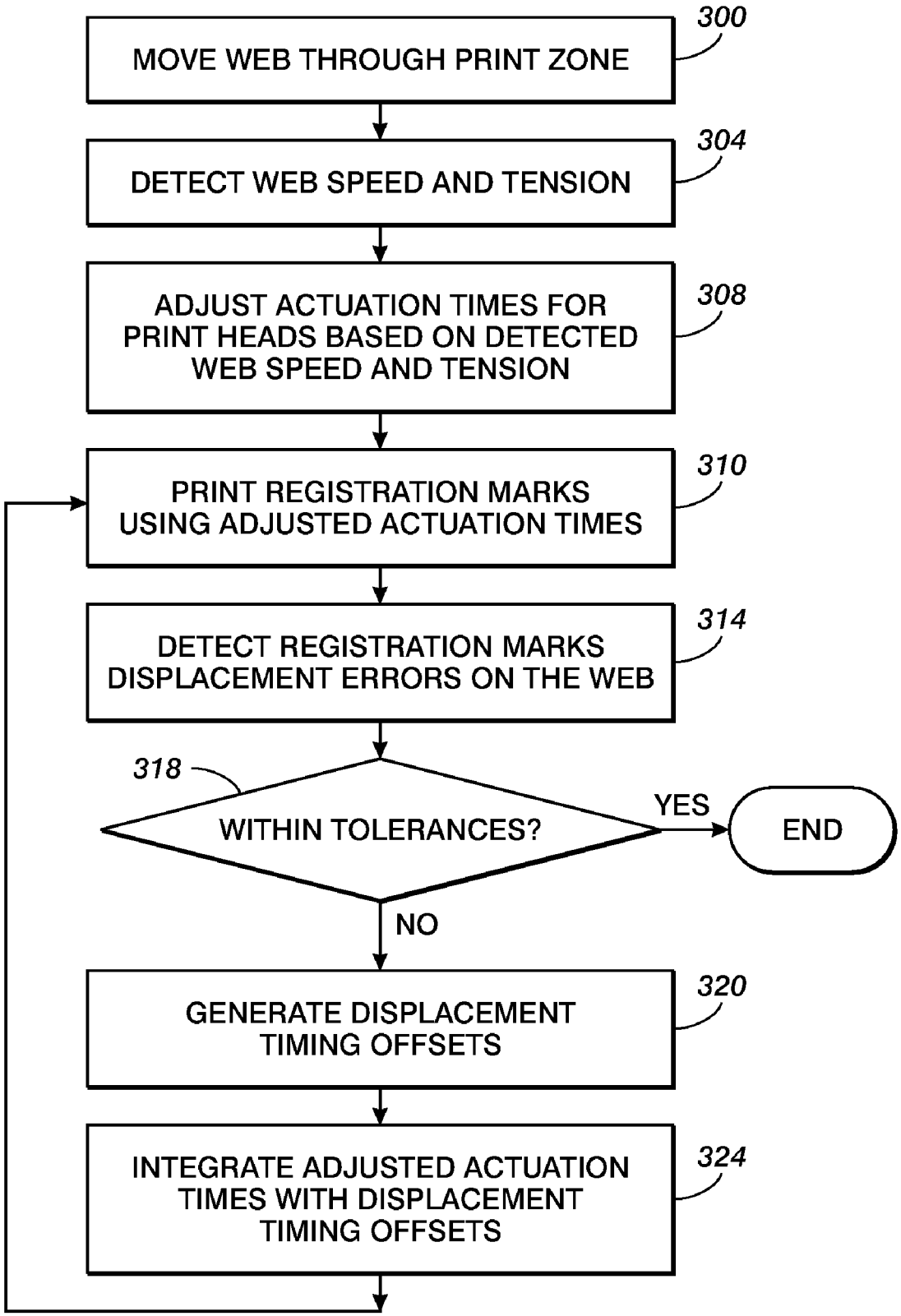
FIG. 4 is flow chart of a method for registering images in the imaging device of FIG. 1.

Referring now to FIG. 4, a flow chart showing an embodiment of a method of registering images that may be implemented using the above described registration system. The method begins with the movement of a web along a web path through a print zone along which is sequentially arranged a first print head and a second print head (block 300). A web speed and a web tension of the web in the print zone is monitored (block 304), and actuation times for the first and second print heads are adjusted based on the detected web speed and web tension to form DRP adjusted actuation times for the print heads (block 308). At least one of the print heads is then actuated to apply a registration mark or marks onto the moving web using the corresponding DRP adjusted actuation time for the print head (block 310). An image sensor adjacent the web is activated to detect process direction deviations of the registration mark from the location on the web that the registration mark was intended to be placed. The image sensor is configured to output reflectance signals to a print head displacement compensation controller that are indicative of the process direction deviation or displacement of the registration mark. The reflectance signals may then be processed to determine the corresponding print head displacement for the print head (block 314). The print head displacement value is compared to a threshold displacement value or range of values to determine if the print head displacement is requires correction or if the print head displacement indicates a fault condition that may require service (block 318).

If a detected print head displacement requires correction and/or does not indicate a fault condition, a print head displacement timing offset is generated for the print head to compensate for the displacement (block 320). Once the print head displacement timing offset for one or more of the print heads has been determined, the displacement timing offset may be saved in memory for the print controller to access so that the displacement timing offset may be used to adjust the DRP adjusted actuation time for the print head (block 324).

Determining a displacement timing offset for a print head based on registration mark feedback may require iterations. For example, after a first round of adjustments has been made to the actuation time of a print head, the process depicted in FIG. 4 may be repeated. A new set of one or registration marks may be applied to the web and scanned by the image sensor to determine if the previous adjustment was effective in eliminating or reducing the print head displacement error. The process may be repeated any suitable number of times to attempt to correct image registration errors caused by print head displacement. After a predetermined number of iterations of the correction process have been performed without adequately compensating for a print head displacement induced registration error, a user alert or service fault may be generated that indicates, for example, that service may be required.

The registration method described in FIG. 4 may be performed at any suitable time and/or interval such as continuously, periodically, or on an as needed basis, and the print head displacement offsets may be updated so that continued changes or variations in print head position may be continuously compensated for over time. Registration errors caused by print head position deviations typically occur at a much slower rate than changes in web tension, therefore, the process of FIG. 4 may be scheduled infrequently relative to the determination of DRP offsets, for example.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A registration system for use with an imaging device, the system comprising:

a first sensor configured to generate a first signal indicative of a speed a substantially continuous moving web, the moving web being configured to receive a marking material applied by at least two marking stations positioned along the moving web;

a second sensor configured to generate a second signal indicative of a tension of the moving web;

an image sensor configured to generate a third signal indicative of a relative position of a marking material applied to the moving web by at least two of the marking stations;

a control system coupled to the first sensor, the second sensor and the image sensor, the control system being configured to generate a first timing offset for the at least one of the marking stations with reference to the first signal and the second signal, and to generate a second timing offset for the at least one of the marking stations with reference to the first, second, and third signals, the first timing offset and the second timing offset each being configured to advance or delay actuation of the at least one marking station to apply marking material to the moving web, the control system being configured to adjust an actuation time for the at least one marking station using the first timing offset and the second timing offset.

2. The system of claim 1, the first sensor comprising a first encoder configured to generate a signal indicative of the web speed at a first location along the moving web.

3. The system of claim 2, the second sensor comprising a second encoder configured to generate a signal indicative of the web speed at a second location along the moving web, the tension being indicated by a difference between the web speed at the first location and the web speed at the second location.

4. The system of claim 1, the image sensor comprising a full width array sensor.

5. The system of claim 1, the at least two marking stations being spaced from each other in a process direction of the web.

6. The system of claim 1, the at least two marking stations each being at the same position and spaced from each other in a cross-process direction of the web.

7. The system of claim 6, the marking material comprising a phase change ink.

8. A method of registering images on a substantially continuous moving web, the method comprising:

detecting a speed of a moving web;

detecting a tension of the moving web;

generating a first timing offset based on the detected speed and the detected tension of the moving web;

adjusting an actuation time for a first and second marking station positioned adjacent the moving web using the first timing offset to form a first adjusted actuation time for each of the first and the second marking stations;

actuating the first and the second marking station to apply a registration mark to the moving web using the first adjusted actuation time;

detecting a process direction deviation of the registration mark applied by one of the first and the second marking stations from the registration mark applied by the other of the first and the second marking stations;

generating a second timing offset based on the detected process direction deviation; and adjusting the first adjusted actuation time for the first and the second marking stations using the second timing offset to form a second adjusted actuation time for each of the first and the second marking stations.

9. The method of claim 8, further comprising:

actuating the first and the second marking stations in accordance with the corresponding second adjusted actuation time during imaging operations.

10. The method of claim 8, the detection of the web speed further comprising:

detecting a web speed using a first encoder positioned at a first location along the moving web.

11. The method of claim 10, the detection of the web tension further comprising:

detecting a web speed at a second location along the moving web using a second encoder; and deriving the web tension from a difference between the web speed at the first location and the web speed at the second location.

12. The method of claim 11, the detection of the process direction deviation of the applied registration marks further comprising:

scanning the registration marks on the moving web with a full width array sensor positioned downstream from the marking stations along the moving web to detect the process direction deviation.

13. The method of claim 12, further comprising:

comparing the detected process direction deviation to a predetermined threshold value; and generating the second timing offset if the detected process direction deviation is greater than the predetermined threshold value.

14. The method of claim 12, further comprising:

storing the second timing offset in memory.

15. An imaging device comprising:

a substantially continuous image receiving web;

a web transport and guidance system for moving the web through a print zone;

a first and a second marking station sequentially positioned in the print zone and configured to apply marking material to the moving web;

a first sensor configured to generate a first signal indicative of a speed the moving web;

a second sensor configured to generate a second signal indicative of a tension of the moving web;

an image sensor configured to generate a third signal indicative of a position of a marking material applied to the moving web by at least one of the marking stations;

a control system coupled to the first sensor, the second sensor and the image sensor, the control system being configured to generate a first timing offset for the at least one of the marking stations with reference to the first signal and the second signal, and to generate a second timing offset for the at least one of the marking stations with reference to the third signal, the first timing offset and the second timing offset each being configured to advance or delay actuation of the at least one marking station to apply marking material to the moving web, the control system being configured to adjust an actuation time for the at least one marking station using the first timing offset and the second timing offset.

16. The device of claim 15, the first sensor comprising a first encoder configured to generate a signal indicative of the web speed at a first location along the moving web.

17. The device of claim 16, the second sensor comprising a second encoder configured to generate a signal indicative of the web speed at a second location along the moving web, the tension being indicated by a difference between the web speed at the first location and the web speed at the second location.

18. The device of claim 17, the second sensor comprising a tensiometer.

19. The device of claim 18, the image sensor comprising a full width array sensor.

20. The device of claim 19, the image sensor being configured to generate a reflectance signal indicative of a reflectance of marking material applied to the web, the displacement controller being configured to correlate the reflectance signal to a process direction deviation of marking material applied to the web from an intended location of the marking material on the web.

* * * * *